United States Patent [19]

Tune

[11] 4,134,501

[45] Jan. 16, 1979

[54] TILTING SERVICE LIFT FOR AUTOMOTIVE EQUIPMENT WITH FOLDING LIFT UNIT

[76] Inventor: Shearer E. Tune, P.O. Box 652, Fulton, Ky. 42041

[21] Appl. No.: 795,423

[22] Filed: May 10, 1977

[51] Int. Cl.[2] ..... B66F 7/22

[52] U.S. Cl. ..... 214/1 A; 187/8.43; 187/8.5; 187/8.67; 254/3 B

[58] Field of Search ..... 214/1 A, 46.34, 47, 214/49; 187/8.43, 8.5, 8.5 A, 8.67, 8.71, 18; 254/3 R, 3 B, 3 C, 8 B, 9 B, 9 C, 124

[56] References Cited

U.S. PATENT DOCUMENTS

| | | | |
|---|---|---|---|
| 2,201,179 | 5/1940 | Jackson et al. | 187/8.5 |
| 2,471,901 | 5/1949 | Ross | 254/9 C |
| 2,602,633 | 7/1952 | Reedy | 187/8.67 |
| 3,315,763 | 4/1967 | Harvey et al. | 187/8.43 X |
| 3,563,345 | 2/1971 | MacMillan et al. | 187/8.43 |
| 3,838,783 | 10/1974 | Tune | 214/49 |

FOREIGN PATENT DOCUMENTS

| | | | |
|---|---|---|---|
| 1300656 | 8/1969 | Fed. Rep. of Germany | 254/124 |
| 1237968 | 7/1971 | United Kingdom | 254/124 |

*Primary Examiner*—L. J. Paperner

*Attorney, Agent, or Firm*—Berman, Aisenberg & Platt

[57] ABSTRACT

A lift for servicing the running gear and underside of a vehicle, embodies a pair of parallel channel-shaped base beams connected at their ends by extensible members. A pair of vehicle-receiving platforms of channel-shape are hinged to and lie directly above and parallel to the base beams. The base channels open upwardly, while the platform channels open downwardly. Within the channels and between each pair of base and platform beams is pivotally mounted a folded lift unit including a fluid pressure applying device having a piston and rod, a lever mechanism including three folded arms and links, a booster fluid pressure device and a safety mechanism. Actuation of the lift units causes them to unfold and elevate the platform beams with a vehicle loaded thereon, to an elevated and inclined position. The safety mechanism includes a rack secured to and moveable with the piston rod, a housing secured to the cylinder of the pressure fluid device, a latching pawl pivoted in the housing, and a tension spring retaining the pawl in engagement with the teeth of the rack at all times except when a second pressure fluid device is actuated to overcome the tension spring and move the pawl away from the rack to permit lowering of the platform beams.

15 Claims, 14 Drawing Figures

TILTING SERVICE LIFT FOR AUTOMOTIVE EQUIPMENT WITH FOLDING LIFT UNIT

This application discloses improvements on the invention covered by my U.S. Pat. No. 3,838,783, titled "Portable Hydraulic Service Lift for Automotive Equipment", and issued Oct. 1, 1974.

FIELD OF THE INVENTION

This invention relates to an hydraulic lift which will accommodate vehicles of various widths and lengths and will elevate the vehicle to a tilted position yielding access to the running gear and underside of the vehicle for servicing.

DESCRIPTION OF THE PRIOR ART

U.S. Pat. No. 3,838,783, referred to above, discloses a portable hydraulic lift including a pair of base beams connected in parallel relation by extensible cross members, and a pair of ramps for driving a vehicle onto a platform hinged to the base beams. Each base beam has an hydraulic piston pivoted thereto at its outside surface and hydraulic cylinders surrounding the pistons are hinged to the outside of the vehicle-receiving platforms. A vehicle wheel-stop is mounted on the platform so that activation of the hydraulic cylinders with pressure fluid elevates the platform and vehicle to a tilted position, the lift cylinders and pistons swinging in vertical planes at the sides of the base beams and platforms and extending above the latter at the sides of the lifted vehicle. For safety against loss of fluid pressure, a rack is secured to the piston rod for movement therewith, and a manually operated pawl is engaged with the rack teeth.

SUMMARY OF THE INVENTION

It is a primary object of the present invention to improve the lift device of the mentioned prior patent so as to accommodate vehicles having wider spaced wheels or tracks or wider bodies. This is accomplished by eliminating lateral and vertical obstructions such as the lifting mechanism units which extend laterally outside the lift and which obstructions would prevent loading of wider vehicles, or by preventing the engagement of portions of the wider vehicles with the lifting mechanism which would prevent proper operation of the latter. To this end, folded pressure fluid lifting units with accompanying safety devices are substituted for the conventional lifting units and are housed within the channels of the base and platform beams rather than at the outsides of the beams.

Another important object of the invention is to prevent damage to the pressure fluid lifting mechanisms which can be caused by the vehicles loaded on the conventional lift device. This object is accomplished by enclosing the lifting mechanisms and their safety devices within and between the channelled base and platform beams, the unfolding action of the lifting mechanisms occurring within the vertical confines of the housing beams so that the lifting mechanisms are protected at all times, during operation as well as at rest.

A further object of the invention is to improve the safety of operation of the lift device by provision of an automatic safety latching device which is pressure fluid operated and which eliminates the dangers and failures possible when human operation and activation is involved as in the conventional lift device.

Still other objects of the invention are to simplify the structure, assembly and fabrication of the conventional lift device and thereby facilitate its use and lessen its cost. To this end two platform beams and two loading ramps are used rather than three as in the conventional lift device; screw operated beam connectors for adjusting the spacing of the base and platform beams, together with indicia showing the spacing, are utilized; and accessory devices of simpler structure and greater versatility are provided.

DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of a specific embodiment when read in connection with the accompanying drawings, wherein like reference characters indicate like parts throughout the several figures and in which:

DESCRIPTION OF THE PREFERRED EMBODIMENT

Figure 1:
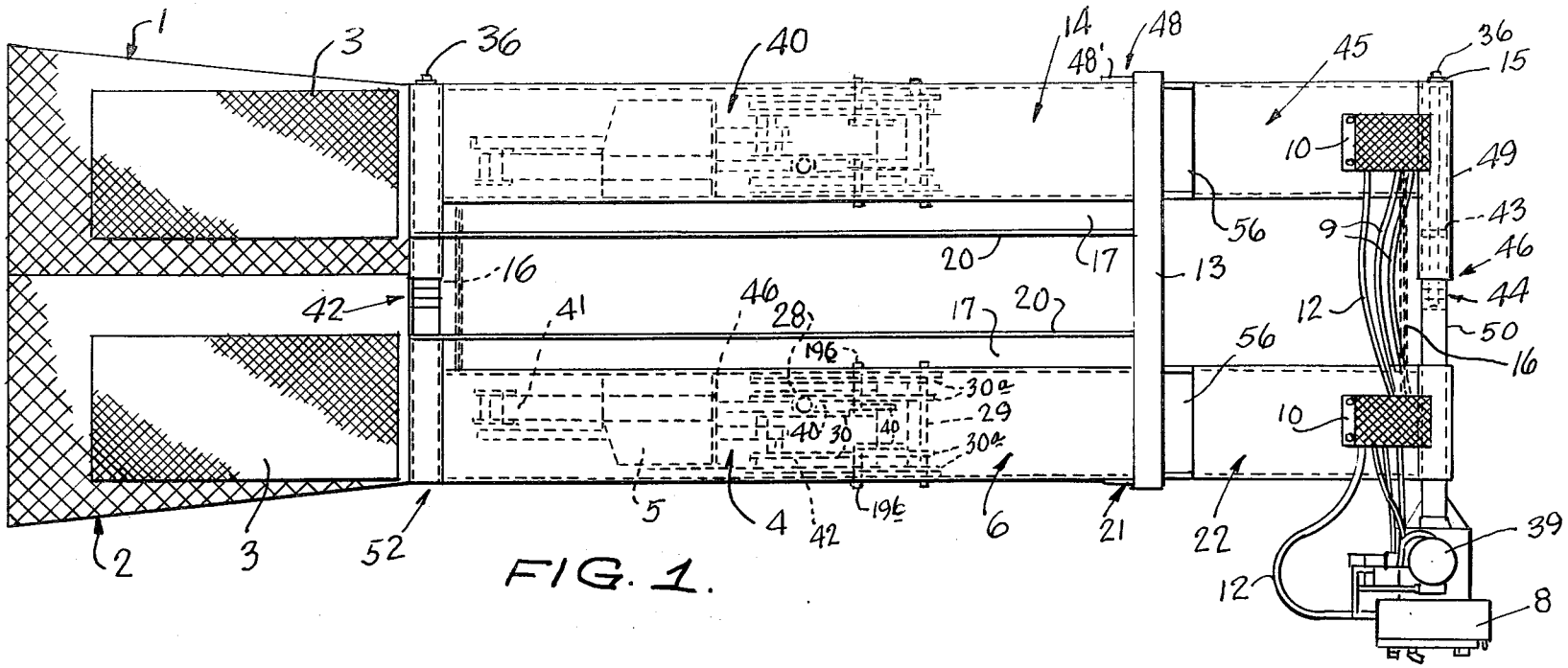
FIG. 1 is a plan view of the lift device according to the invention.

For a general understanding of the structure and mode of operation of the present apparatus, reference is made to U.S. Pat. No. 3,383,783, mentioned above, whose detailed structure and functioning is similar except as will be noted from the following description. Like the patented device, the present device is intended to handle fork lift trucks, or small vehicles like jeeps, but the present device can be made to lift extremely heavy and large vehicles such as military tanks, construction bulldozers, and the like.

The invention as a whole will best be understood by reference to FIGS. 1 through 4. Basically, the machine is formed as a pair of parallel, right and left base beams, 22 and 45, which are inverted channels opening upwardly. These beams are joined at their adjacent free ends by expansible connectors 46 and 47 which permit adjustment of the space between beams 22 and 45 to accommodate various tread widths of the vehicles to be serviced.

A pair of channel-shaped platform beams 6 and 14 respectively, overlie the base beams and are joined to the latter by pivot joints generally designated 21 and 48. Beams 6 and 14 have their open sides facing downwardly. Folded, pressure fluid lifting units, generally designated 4 and 40, are enclosed within and between the pairs of base and platform beams 22, 6 and 45, 14 respectively. These lifting units are important novel features of the invention and will be described in detail later. The unpivoted ends of the platform beams 6, 14 are joined by an expansible cross-member 52. Ramps 1 and 2 which overlap one another and cover the entire space between the base beams 22, 45 lead to the upper surfaces of the platform beams 14 and 6. A portion of each ramp surface is covered by wire mesh plate 3 and the ramps are held to the base beam connector 47 by removeable pins 99 which may be placed in spaced openings in the tubing of the connector for lateral adjustment of the ramps. Vertically upstanding wheel-stops 25, 25 are affixed to the pivoted ends of the platform beams 6, 14 and these are joined by an L-shaped top cross-bar 13. The stops 25 are braced by triangular section rib supports 56,56 extending from the upper edges of the stops to the ends of the platform beams.

The expansible members 46, 47 and 52 are each made of a tube 49, see upper right corner of FIG. 1, having one end welded to the end of the connected base or platform beam, for example, 45. A smaller tube 50 has one end telescoped in tube 49 and its other end welded to the other beam 22. The portion of the tube 50 overlapped by and adjacent to tube 49 has stamped, spaced indicia lines and numerals 44 to show the exact amount of telescoping overlap, and hence the adjusted width of the connector tube members. An adjusting screw 36 extends axially within tube 49 with its head protruding therefrom supported by adjusting collar 15. A nut 43 is fixed within the inner end of tube 50 and screw 36 is threaded therein. By turning screw 36 the amount of telescoping is varied, and thus the spacing between beams 22 and 45 or 6 and 14 is varied, to accommodate vehicles of various tread widths. To expand or contract the spacing of platforms 6 and 14 the latter must be in fully down position because the pivoted ends of the platform beams are tied to the base beams. In this lowered position, dogs 53 extending downwardly from cross member 52 (see FIG. 3) engage in slots 54 of connector 47 thus locking the unpivoted ends of the platform beams to the base beams for joint lateral adjustment movements. Adjusting screws 36 at both ends of the lift must be adjusted (in or out) by wrench, until the desired width is obtained. A safety chain 16 connects opposite ends of the base beams 22, 45 to limit their maximum spacing. The stop bar 13 is bolted onto wheel-stops 25. Stop bar 13 is also adjustable by long slotted holes (not shown).

The pivots 21 and 48 include brackets 21' and 48' which are secured to the outer sides, or flanges, of beams 22, 45 respectively. These brackets support transverse pivot pins 55, 55 extending from the platform beams 6, 14. The pins are rotatably installed in heavy bosses (not shown) having oil impregnated bushings and carried by the brackets.

The folding lift units 4, 40 are identical except for matters of left or right hand. Only one, therefore, will be described in detail and with particular reference to FIGS. 1–3, 10 and 11. As best seen in FIG. 3, each lift unit includes a double acting, pressure fluid cylinder 4' pivoted at its lower end by pin **4*a* and brackets 27, 27 to the web of base channel beam 22. A piston (not shown) within the cylinder is connected to a protruding piston rod 4*b*. The piston rod is hinged to one arm 30 of a multiple arm, fabricated, lever mechanism by pin 42. The arm 30 is fixedly secured to a second arm 30*a* at a slight angle thereto. At the vertex of this angle, arm 30*a* is pivoted to the base beam by pin 29 passing through both flanges of the channel base beam 22. The other end of arm 30*a* is pivoted to a link arm 19 by pin 19*a*. The opposite end of link arm 19 is pivoted by a pin 19*b* to the platform beam 6 through brackets 40, 40, FIGS. 10 and 11, welded to its underside. Activation of pressure cylinder 4' unfolds the lifting unit from the folded condition of FIG. 2, in which the lift unit is enclosed and entirely protected from the vehicle being lifted, to the condition of FIG. 3 in which the vehicle is elevated to a tilted position. A booster cylinder 26 is provided to assist with added upward force at the beginning of upward motion of the platform beam. Cylinder 26 has a stroke of only several inches and its piston pushes on a guideplate 28 secured in the top part of arm 30*a*. Cylinder 26 is pivoted to support brackets 26*a* by pins 26*b* (see FIG. 10**).

Figure 10:
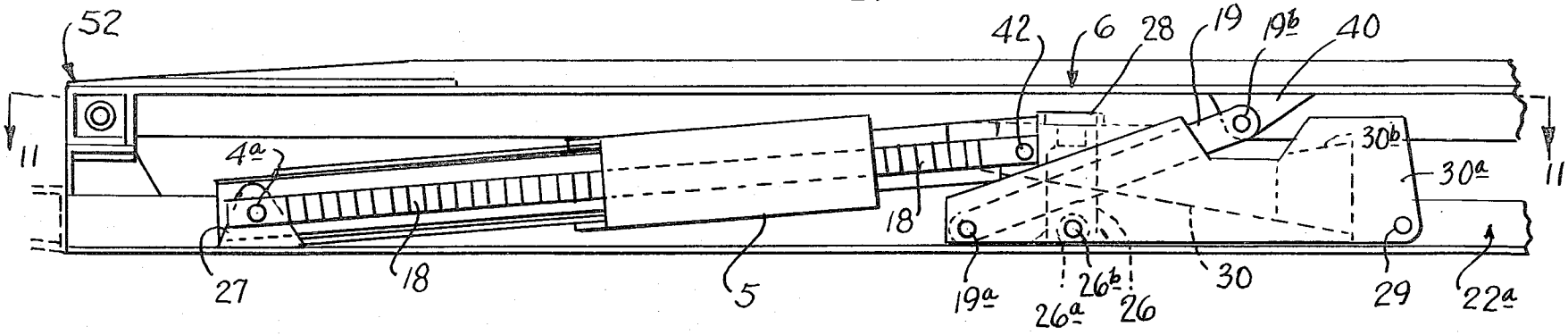
FIG. 10 is an enlarged elevation taken from the right side of the lift device and showing only one of the folded lift units in lowered, or folded condition.
Figure 11:
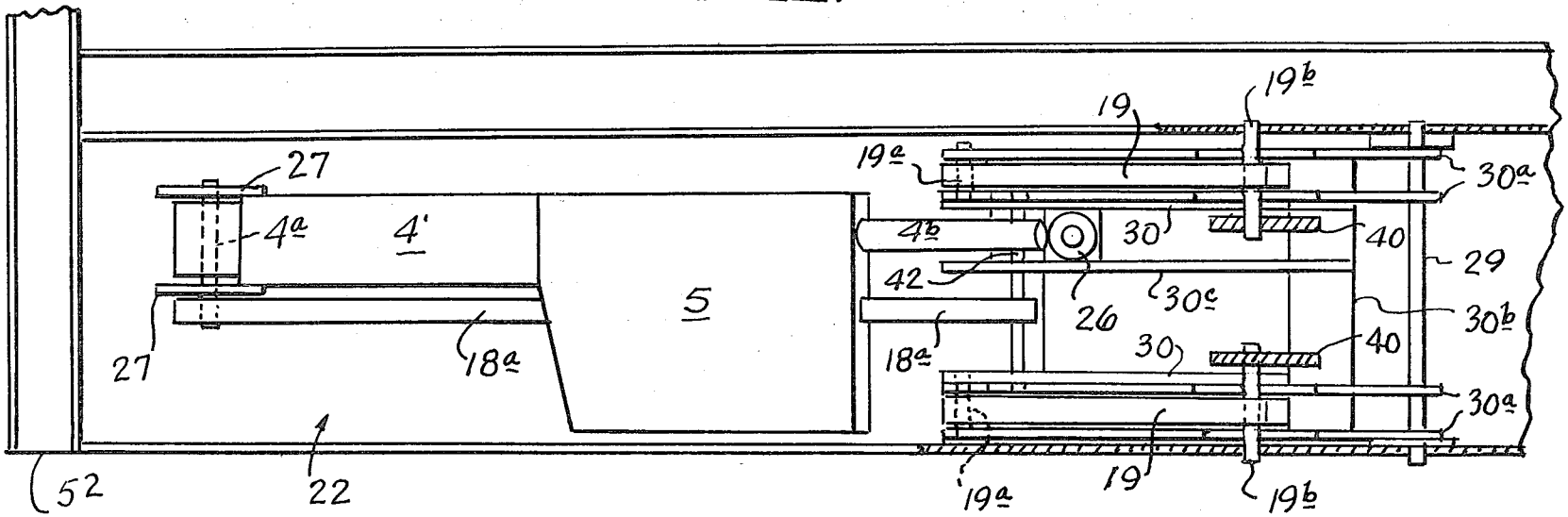
FIG. 11 is a sectional plan view taken on line 11—11 in FIG. 10 and looking in the direction of the arrows.
Figure 12:
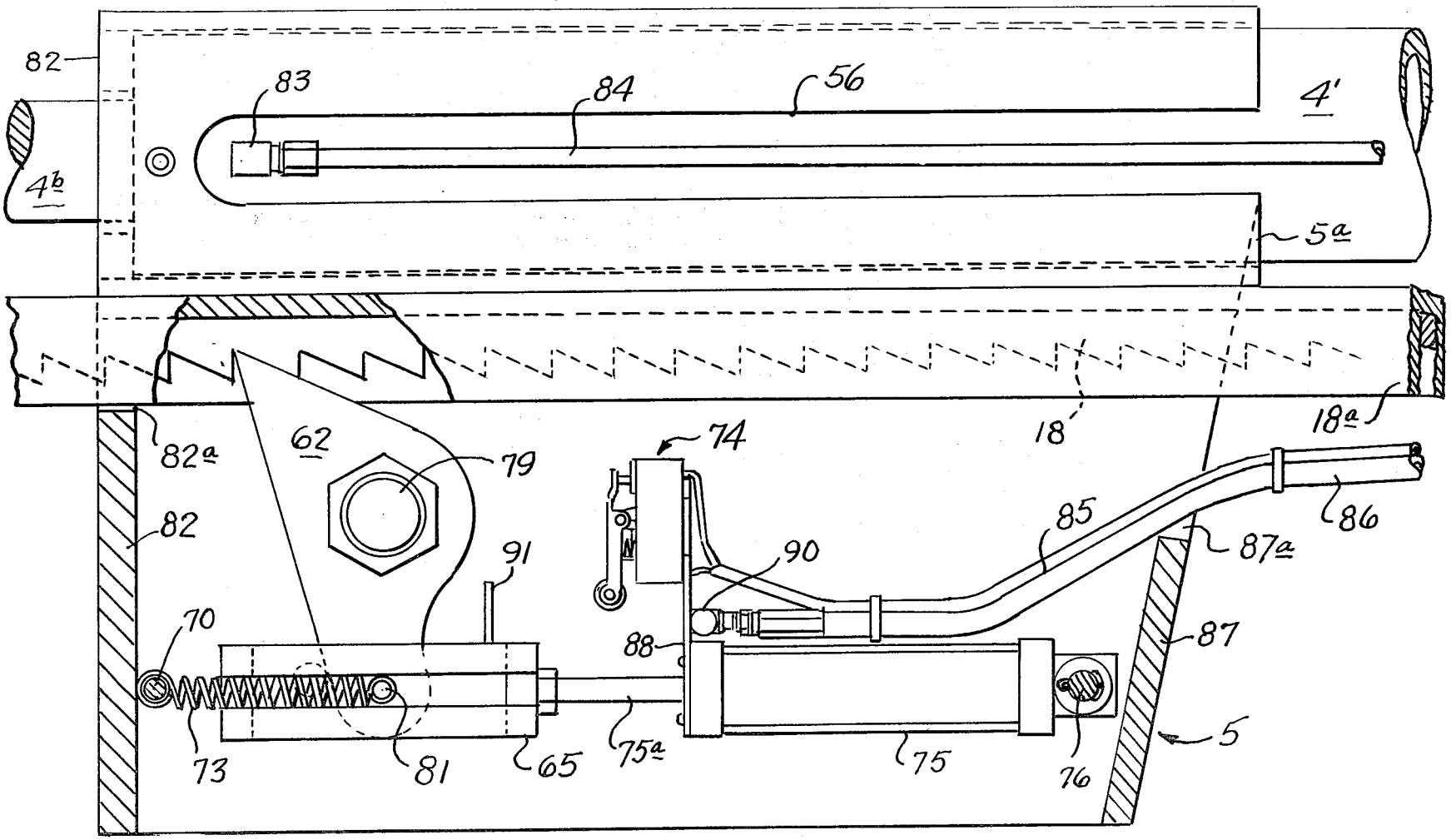
FIG. 12 is an enlarged sectional plan view revealing details of the safety housing, safety rack and latch mechanism, taken on line 12—12 in FIG. 13 and looking in the direction of the arrows.
Figure 13:
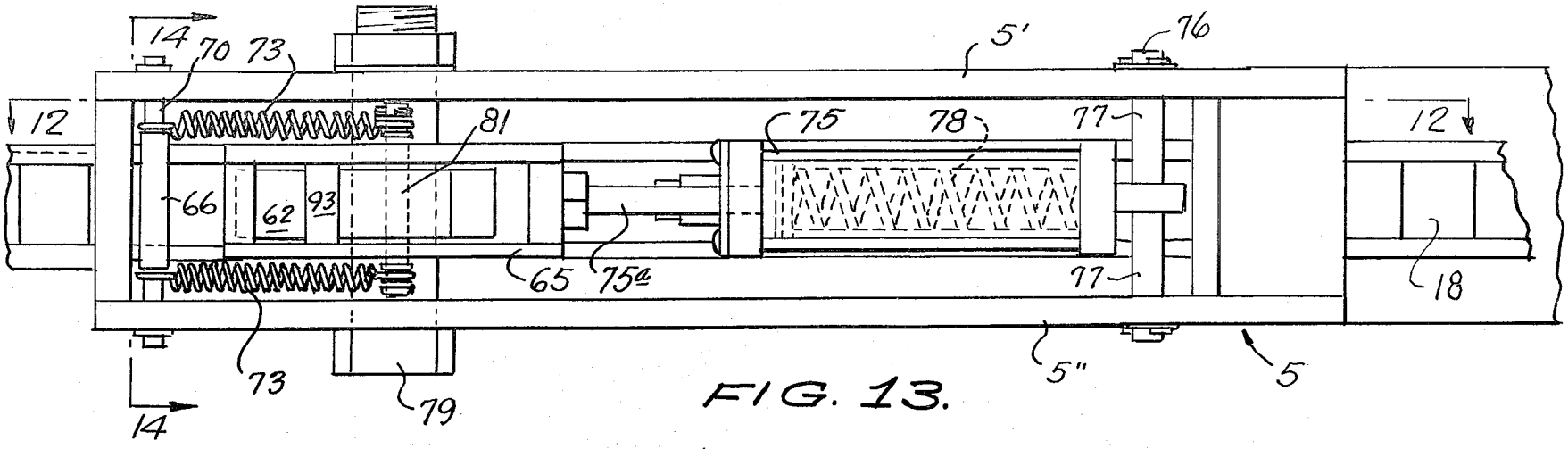
FIG. 13 is an enlarged elevational view of the safety mechanism only taken from the left side of the left lifting unit.
Figure 14:
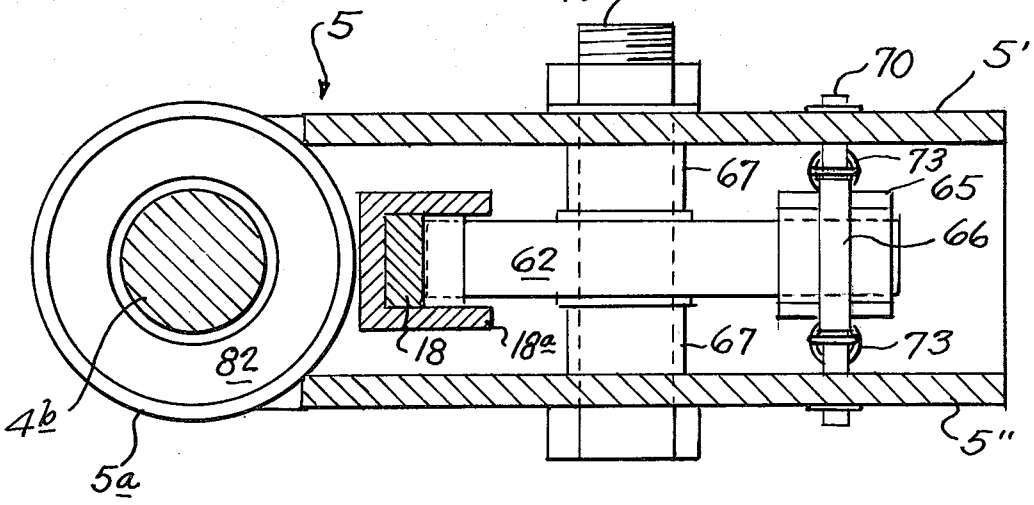
FIG. 14 is a sectional end view taken on line 14—14 of FIG. 13, and looking in the direction of the arrows.

The folding fabricated lever mechanism, as above-briefly described, is more clearly shown in FIGS. 10 and 11 as being a strong multi-arm device sitting within and between the flanges of the pairs of base and platform beams. Thus, there are two pairs of arms **30*a* seated inside and adjacent the web of beam 22 at the sides thereof and hinged to its flanges by pin 29. Each pair of arms 30*a* may if desired be the flanges of a U-cross section, channel bar. A cross-bar 30*b* joins the quadruple arms 30*a*. The right hand ends of the pair of arms 30 are welded to the cross-bar 30*b*, and if desired to portions of adjacent arms 30*a*, with arms 30 inclined upwardly to the left at a slight angle. This positions the connecting pivot 42 to the piston rod slightly above pivots 29 and 19*a* so as to insure that arms 30 will be turned to unfold the lever mechanism and lift the platform beams when the cylinder 4' is pressurized. An arm 30*c*, similar to arms 30, is also welded to cross-bar 30*b* as a central reinforcement for pivot pin 42. A pair of arms 19 are used, each folding at least partly within and between a pair of the arms 30*a*. The maximum angle of tilt of the lifted vehicle, as shown in FIG. 3, is governed by the dimensions of the fabricated lever mechanism and the amount of extension of the platform beams 6 beyond pivots 55, 55**, the ends of these beams acting as stops upon striking the base beams. These structural features and dimensions may be modified to increase the angle of tilt to 90° to the horizontal, if desired.

Referring now more particularly to FIGS. 10–14, it will be seen that each lifting unit includes an automatic safety mechanism as will now be described. Connected to the piston rod **4*b* by the pin 42 is a safety rack 18 secured in a channel bar 18*a* with the rack teeth facing outwardly. A safety housing 5 is secured to the upper part of the cylinder 4'. The housing has a cylindrical portion 5*a* surrounding the cylinder with a cap 82** having a central opening through which passes the piston rod 4*b*. A portion of the cylindrical part 5*a* is slotted at 5*b* to leave space for the pressure fluid fitting 83 and access for the pressure fluid tubing 84. The remainder of the housing 5 comprises a box-like structure welded to cylindrical part 5*a* and including upper and lower walls 5′ and 5″, a forward wall 82 and rear plate 87. The outer side of housing 5 is open. The rack 18 moves with the pressure cylinder piston rod, to which it is connected, passing through openings 82*a* and 87*a* in the housing, the former opening acting as a guide for such movement. A latching safety dog 62 is centrally pivoted on bolt 79 passing through openings in housing walls 5′ and 5″, and is held spaced from these walls by collars 67, 67. To retain the dog, or pawl 62, in engagement with the teeth of rack 18, there is provided a cage 65 having a pin 81 vertically disposed and freely moveable therein and passing through an opening in pawl 62 on the end opposite the pawl tooth. A pair of tension coil springs 73, 73 are hooked over the ends of pin 81. The other ends of the springs, spaced by collar 66, are hooked over pin 70 which is fastened to housing walls 5′, 5″ so that the springs urge pawl 62 clockwise and the cage 65 toward the left as viewed in FIG. 12. Another pin 76 is vertically secured between walls 5′, 5″ and to it is pivoted a single acting, pressure fluid cylinder 75 spaced by a pair of collars 77, 77 surrounding the pin. The piston within cylinder 75 is pressed toward the left as viewed in FIG. 13 by spring 78, and piston rod 75*a* is bolted to cage 65 so that application of pressure fluid to cylinder 75 moves the piston against the opposition of spring 78 to the right. This movement causes movement of contact block 93 affixed to cage 65 and the cage in the same direction, turning the pawl 62 counter-clockwise (FIG. 12) and out of engagement with the toothed rack 18, thus permitting the lift platform beams to be lowered. Affixed to the cylinder 75 is a plate 88 mounting a limit switch 74. A limit switch trip finger 91 is carried by cage 65 so that upon release of the pawl 62, the trip finger will actuate switch 74 to open an electric circuit governing pressure fluid valve control to the main lift cylinder 4′. Tubing 86 conducts pressure fluid to fitting 90 on cylinder 75. Cable 85 encloses wiring to the limit switch 74.

Figure 2:
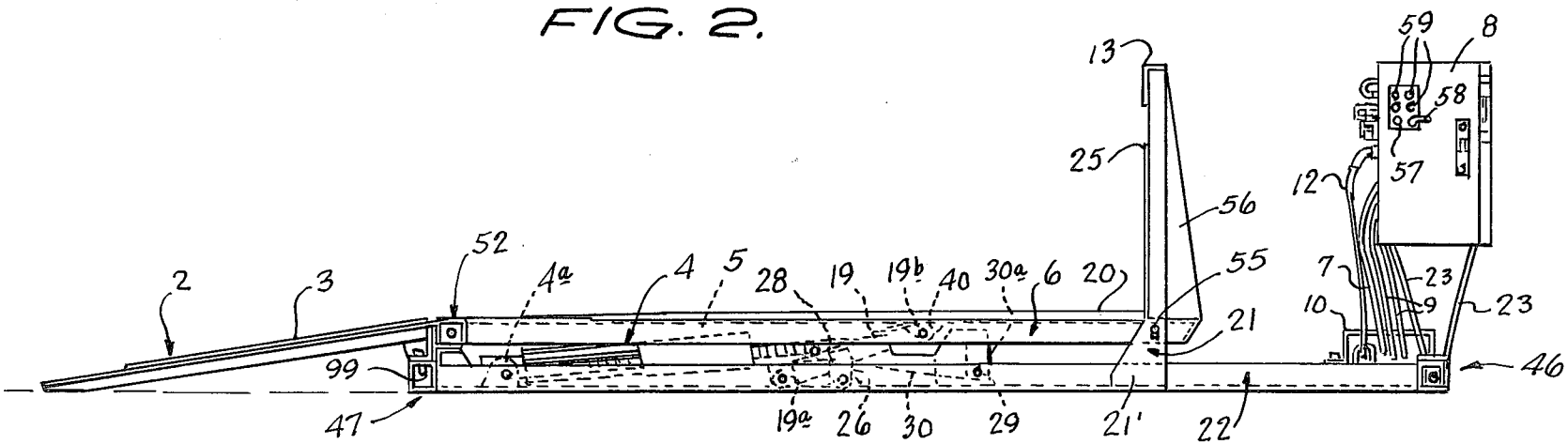
FIG. 2 is a front elevation of the device shown in FIG. 1.
Figure 3:
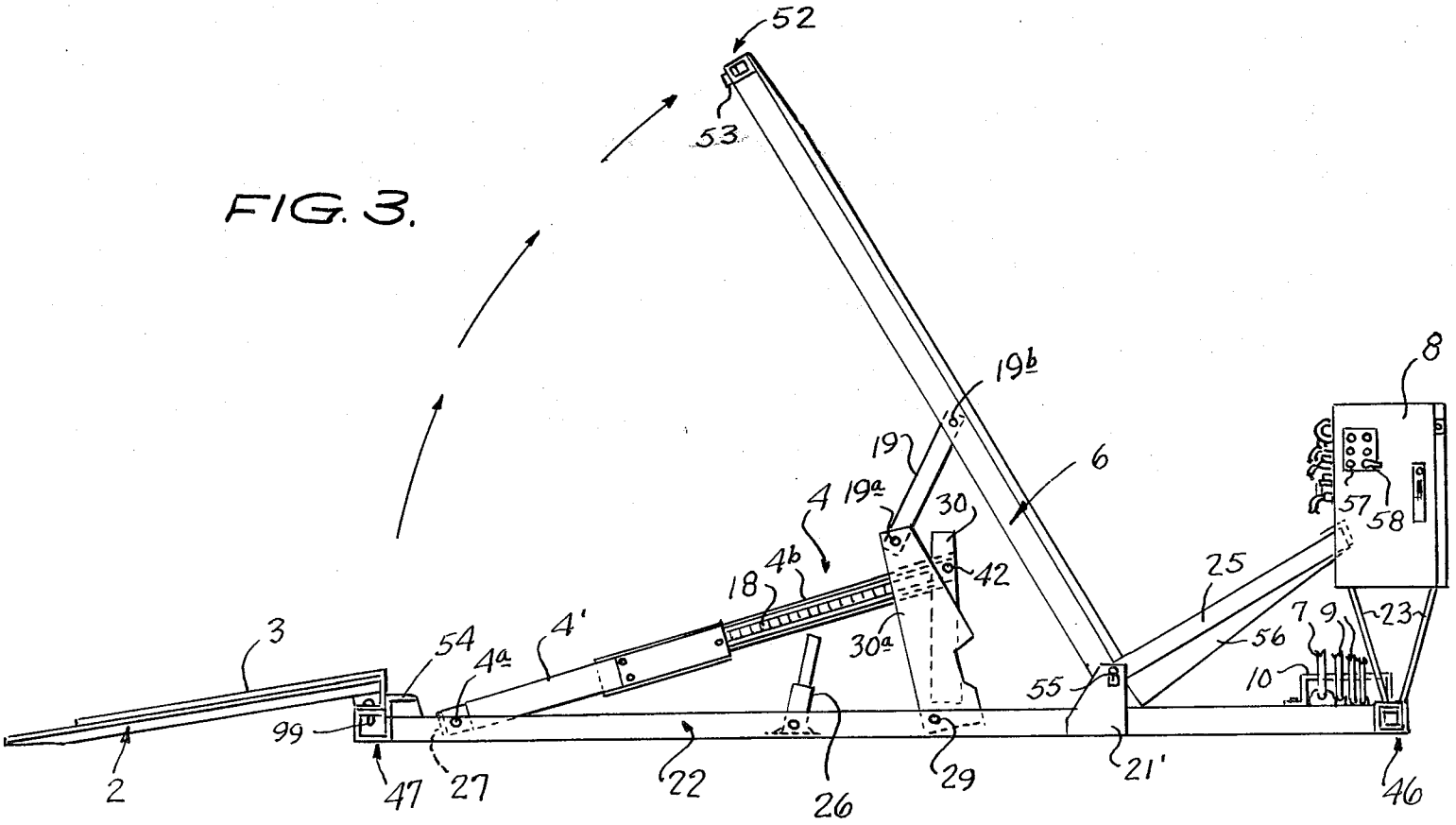
FIG. 3 is an elevation similar to FIG. 2 but showing the lift platform in elevated condition.

Mounted at the right end of the device, as viewed in FIGS. 1–3, is a pump 39 and control panel 8 supported from connector 46 by legs 23. The pump and panel are connected to the pressure fluid cylinders of the lift units by hoses 9 protected by hose guards 10, 10. Cables for electrical control are shown at 7 and 12. On the panel a control button switch 57 for the pump, a control lever 58, and indicator lamps 59 are shown.

In use and operation of the lift device as described above, the vehicle to be lifted is driven up ramps 1 and 2 onto the upper surfaces of platform beams 6 and 14 until it encounters wheel stops 25 and stop bar 13, after which it is secured (if necessary) in a conventional manner by chains and clamps (see U.S. Pat. No. 3,838,783). The hydraulic pump is activated by button switch 57 and the "Raise" and "Lower" selector lever 58 is moved to "Raise" position. This activates the pressure cylinders 4′, 4′ and 26, 26 causing the lift units to unfold and elevate the platform beams 6, 14 to their tilted positions of FIG. 3. When the cylinders 4′, 4′ are pressurized the cylinder rams advance the pivots 42 upwardly. This movement of pivots 42 causes upward advance of the fabricated lever mechanisms including arms 30 and 30*a*, which in turn causes an upward advance of the arms 19 at pivots 19*a*. The movement of arms 19 force the platform 6 and 14 to incline to any desired angle. At the start of upward movement cylinder 26 is pressurized to increase the initial lifting force.

As the platform beams 6, 14 begin to raise, the safety racks 18 begin their upward travel allowing the spring loaded safety pawls 62 to be in continuous contact with the teeth of racks 18. Pivot 81 freely travels within the cage 65. Tension on the spring 73 urges the pointed ends of the safety dog 62 into engagement with the teeth of the rack. This is an automatic safety feature to prevent collapse of the device in the event of hydraulic failure during a lift, and also to provide safety later when working under the vehicle.

When it is desired to lower the lift platform 6 and 14, the control lever 58 is moved to "lower" position and held until the vehicle reaches floor level. When the control lever is moved to "lower" position, the lifting platforms 6 and 14 will raise just enough to clear the safety dogs 62 from the teeth of safety racks 18. At this point hydraulic cylinders 75 move the cages 65 and the contact blocks 93 against latches 62 to free the latches from racks 18 and hold them in open position. As cage 65 is moved the limit switch trip plate 91 activates the limit switch 74 which electrically shifts the valve controlling the double-acting cylinder 4′. The hydraulic and electrical control circuits are so arranged that both limit switches must be activated to shift the appropriate valves before the platform beams will lower.

The lift will continue down as long as the control is held in "lower" position. The lift may be stopped in any position but when the control lever is moved to a neutral position, hydraulic pressure in the cylinders 75 is released, the return springs 78 in these cylinders move the cages 65 and activate the safety pawls 62 to engage the racks and hold the lift.

When fully lowered the operator removes the chain hooks and binders from the vehicle and drives, or backs, the vehicle off the lift.

Figure 4:
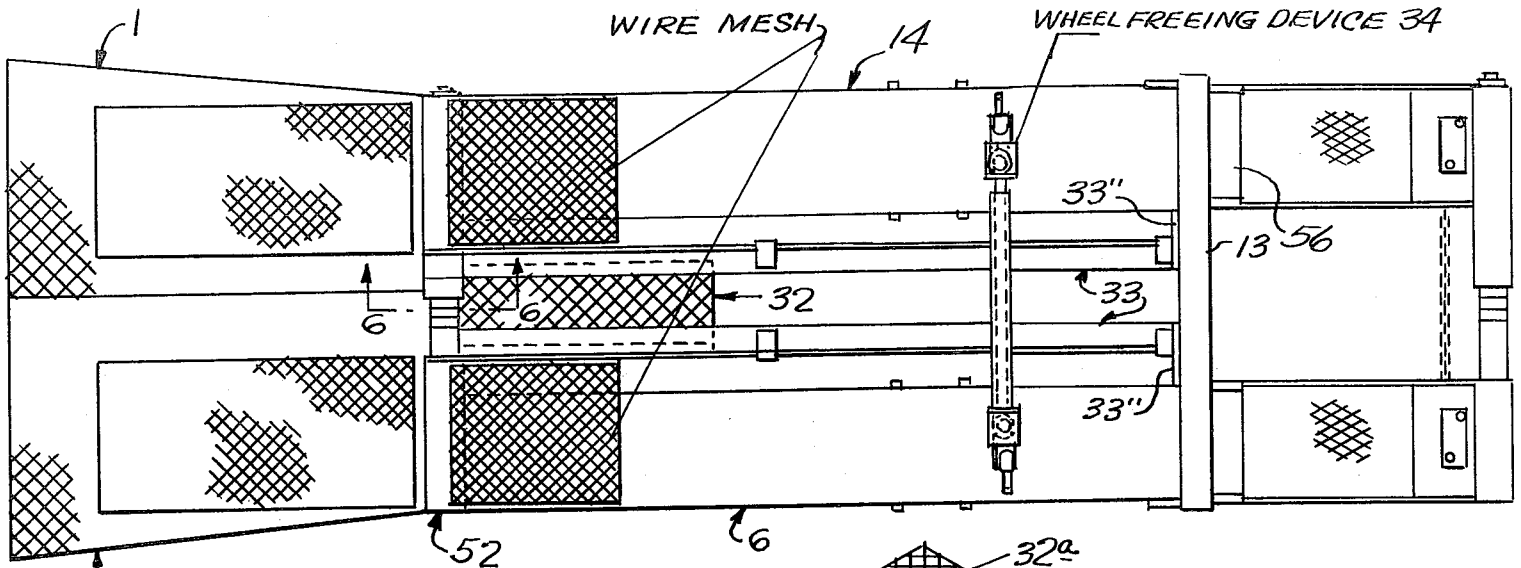
FIG. 4 is a plan view similar to FIG. 1 but showing various accessory devices added to the lift unit.
Figure 5:
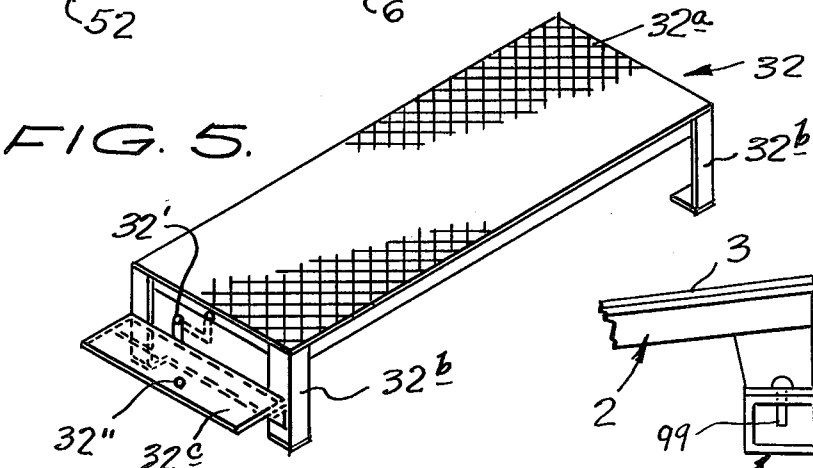
FIG. 5 is a perspective view of a center accessory stand.
Figure 6:
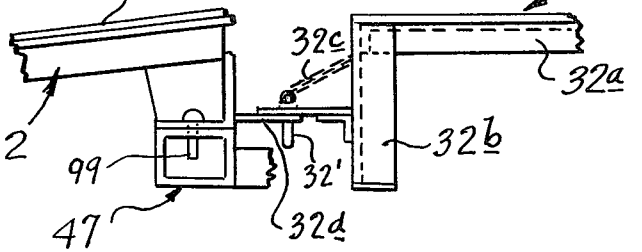
FIG. 6 is a fragmentary elevation showing connection of the center accessory stand to the lift device.

A center stand accessory 32 as shown in FIGS. 4–6 may be optionally installed between the two platform beams 6, 14. Stand 32 comprises a horizontal platform 32*a* supported on four legs 32*b* resting on the ground or floor. A mounting plate 32*c* is carried by brackets mounted on a pair of the end legs. A similar plate 32*d* extends from ramp 1. The installed stand is easily located by dropping pin 32′ in opening 32″ overlying similar location openings or slots in plate 32*d*. The location slots are provided with suitable indicia so as to correctly center the accessory stand for any adjustment of the base beam spacing. The center stand remains on the floor even when the platform beams are elevated to raised position. This establishes freedom of the center wheel on the lifted vehicle so that it may be easily serviced.

Figure 8:
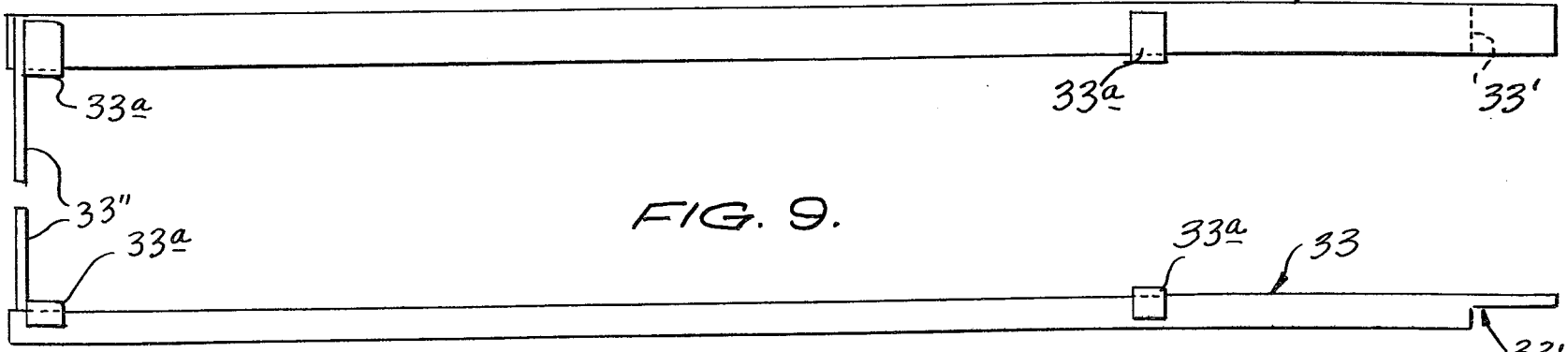
FIG. 8 is a plan view of a pallet jack accessory.
Figure 9:
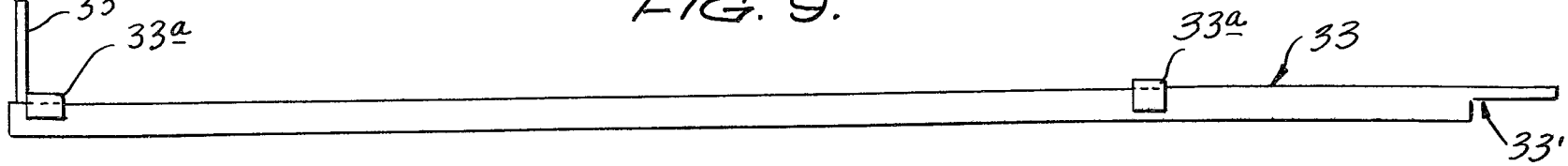
FIG. 9 is an elevation of the pallet jack accessory shown in FIG. 8.

A pallet jack accessory device 33 as illustrated in FIGS. 4, 8 and 9 provides for servicing of pallet jacks of lift trucks by yielding additional lifting beam surfaces for the pallet jack wheels. An inwardly disposed upstanding guide rail 20 (FIGS. 1 and 2) is provided on each of the platform beams 6, 14 by bolting, welding or otherwise securing one flange of a Z-bar 17 to the innermost flange of the beam, the other flange, of bar 17 shown at 20, constitutes the guide rail and its upper edge is slightly higher than the platform beam surface. The accessory device 33 constitutes a flat bar having a pair of L-shaped clips 33*a* having downturned flanges spaced from one side edge of the bar. These clips enable the accessory bars to be inserted over rails 20 to hold the bars in place. Each bar has a notch 33′ on the underside of one end which fits over the connector 52 and an inwardly and upwardly extending plate 33″ acting as an extension to a wheel stop 25.

Figure 7:
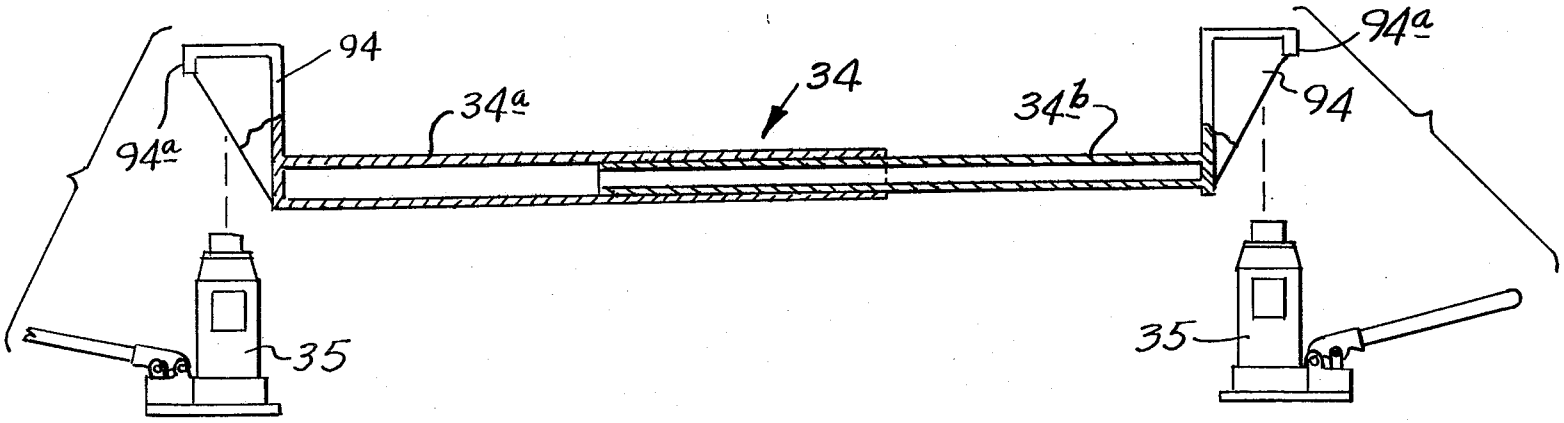
FIG. 7 is an elevation, partly in section, of a wheel-freeing accessory device.

Another accessory, a wheel freeing device 34 supports one or both ends of the lifted vehicle so that its wheels are free of the platform beams and can be removed for replacement as well as for brake overhaul. Referring to FIGS. 4 and 7, the wheel freeing device 34 is made of a large tube 34*a* and a small tube 34*b* telescoped together, with fabricated lifting brackets 94 welded perpendicular to the tubes at the tube ends. The wheel freeing device is simply slid under a vehicle and adjusted to proper width. An hydraulic jack 35 is placed under each lifting bracket 94 and the vehicle is raised to the necessary height to free the wheel. The jacks 35, 35 rest on the lifting platform 6, 14. A slip bar 94*a* welded onto the lifting brackets prevents the jacks from slipping or kicking out from beneath the wheel freeing device.

Although a certain specific embodiment of the invention has been shown and described, it is obvious that many modifications thereof are possible. The invention, therefore, is not intended to be restricted to the exact showing of the drawings and description thereof, but is considered to include reasonable and obvious equivalents.

What is claimed is:

1. A device for tilting a vehicle to permit servicing of the running gear and underside thereof, comprising:
   (a) a pair of spaced, parallel base beams, each base beam comprising an upwardly facing channel;
   (b) a pair of spaced, parallel vehicle receiving platform beams, each platform beam comprising a downwardly facing channel disposed directly above a corresponding base beam and pivoted at one end thereto;
   (c) a pair of connectors for said base beams and a pair of cross members connecting said platform beams wherein each of said base beam connectors and platform beam cross members comprises a pair of telescoping tubes, a bolt extending axially along one tube and havings its head protruding therefrom, a nut affixed within the other tube, and said bolt being threaded in said nut, whereby turning the bolt head serves to vary the overall length of the telescoped tubes and thereby the spacing between the base beams and the platform beams;
   (d) at least one folding lift unit including a fluid pressure applying device and a lever mechanism entirely enclosed within the space formed by an upwardly facing base beam channel and a mating downwardly facing platform beam channel;
   (e) said fluid pressure applying device being connected to one of said mating channels and to said lever mechanism and said lever mechanism also being connected to the other of said mating channels; and
   (f) means for applying fluid pressure to said pressure applying device whereby to tilt said platform beams relative to said base beams.

2. A device according to claim 1, wherein a second folding lift unit including a fluid pressure applying device is provided within and between the other of said base beams and its mating platform beam, and said means for supplying fluid pressure simultaneously activates both fluid pressure applying devices.

3. A device according to claim 2, wherein each said lever mechanism comprises first and second arms rigidly secured to each other and forming a small acute angle with one another, said first arm being pivoted near the vertex of said angle to a base beam, the second arm being pivoted at its free end to said fluid pressure applying device and a lever arm pivoted at one end to an intermediate portion of the associated platform beam and having its other end pivoted to the free end of said first arm.

4. A device according to claim 3, wherein each of said lift units further includes a second fluid pressure device having a protruding piston element, said second fluid pressure device being upwardly directed and having its lower porton pivoted to a base beam and its piston element bearing on a portion of an associated platform beam, whereby to assist and boost the lifting force of the lift unit during the initial stage of tilting the associated platform beam upwardly.

5. A device according to claim 1, further including a safety mechanism for each of said lift units comprising a rack pivotally secured at one end to the fluid pressure applying device, a safety housing secured to the fluid pressure applying device, said rack passing through openings in said housing and being guided in its travel by one of said openings, a latch pawl engaging said rack and pivoted within the housing, said pawl being retained in engagement with the teeth of the rack by a tension spring means connected to the pawl so as to prevent collapse of the platform beams in the event of fluid pressure failure.

6. A device according to claim 5, wherein said safety mechanism for each of said lift units further includes a single acting pressure fluid cylinder pivotally connected to and within the safety housing and having a piston rod pivotally connected to said pawl so that upon operation of said single acting pressure fluid cylinder said tension spring means is stretched and the pawl is turned out of engagement with its associated rack to permit lowering of the platform beams.

7. A device according to claim 1 further including a center accessory stand detachably secured to said device and disposed between the base beams, said stand comprising a horozontal platform supported by legs at the height of the platform beams, when disposed parallel to the base beams, and being adapted to receive the center wheel of a three wheeled vehicle being loaded on the lift device.

8. A device according to claim 1, wherein each of said platform beams has removeably affixed thereto a bar having a Z-shaped cross section so that one flange of each bar provides an upstanding rail parallel to the beam and positioned between the beams, and a pair of flat beams removeably clipped onto said rail portions of the bars at the upper level of the platform beams to provide support for the pallet jack of a vehicle inwardly of the platform beams.

9. A device for tilting a vehicle to permit servicing of the running gear and underside thereof, comprising:
   (a) a pair of spaced, parallel base beams;
   (b) a pair of spaced, parallel, vehicle receiving platform beams, each of said platform beams being pivoted at one end to and above one of said base beams;
   (c) a folding lift unit including a fluid pressure applying device and a lever mechanism housed within and between one of said base beams and its associated platform beam;

(d) said fluid pressure applying device being connected to one of said members of said associated base and platform beams, and to one part of said lever mechanism, and another part of said lever mechanism being connected to the other member of said associated base and platform beam;

(e) means for supplying fluid pressure to said pressure applying device whereby to tilt said platform beams relative to said base beams; and (f) a safety mechanism for each of said lift units comprising:

i — a rack pivotally secured at one end to the fluid pressure applying device;

ii — a safety housing secured to the fluid pressure applying device, said rack passing through openings in said housing and being guided in its travel by one of said openings;

iii — a latch pawl engaging said rack and pivoted within said housing;

iv — said pawl being retained in engagement with the teeth of the rack by a tension spring means connected to the pawl so as to prevent collapse of the platform beams in the event of fluid pressure failure;

v — a single acting pressure fluid cylinder pivotally connected to and within the safety housing and having a piston rod pivotally connected to said pawl;

vi — a moveable cage;

vii — a moveable pin within said cage and pressing through an opening in the pawl on the end opposite the pawl tooth and spaced from the pawl pivot;

viii — said tension spring means being connected to said pin at one end and to a wall in the safety housing at the other end, said piston rod of the single acting pressure fluid cylinder being connected to said cage;

ix — said cage having a contact bar which, upon actuation of said cylinder and movement of said cage, engages the pawl to turn the same out of engagement with the rack against the opposition of said tension spring means and permit lowering of the platform beams.

10. A device according to claim 9, wherein each said cage has a trip plate projecting therefrom and each said single acting pressure cylinder has a limit switch mounted thereon so arranged that upon completion of movement by the cage engendered by actuation of the single acting fluid pressure cylinder, the trip plate will strike and open said limit switch to shift hydraulic valve to reverse pressure to the double acting pressure fluid cylinder.

11. A device for tilting a vehicle to permit servicing of the running gear and underside thereof, comprising:

(a) a pair of spaced, parallel base beams;

(b) a pair of spaced, parallel, vehicle receiving platform beams, each of said platform beams being pivoted at one end to and above one of said base beams;

(c) a folding lift including a fluid pressure applying device and a lever mechanism housed within and between one of said base beams and its associated platform beam;

(d) said fluid pressure applying device being connected to one of said members of said associated base and platform beams, and to one part of said lever mechanism, and another part of said lever mechanism being connected to the other member of said associated base and platform beam;

(e) means for supplying fluid pressure to said pressure applying device whereby to tilt said platform beams relative to said base beams; and (f) an individual ramp detachably secured to each of said base beams adjacent the ends of said beams opposite the pivots of said platform beams, said ramps completely covering the space between and overlapping one another in the direction transversely of the base beams and having adjustable cross members for varying the ramp spacing in said transverse direction.

12. A device according to claim 11, including a pair of connectors for said base beams and a pair of cross members connecting said platform beams wherein each of said base beam connectors and platform beam cross members comprises a pair of telescoping tubes, a bolt extending axially along one tube and having its head protruding therefrom, a nut affixed within the other tube, and said bolt being threaded in said nut, whereby turning the bolt head serves to vary the overall length of the telescoped tubes and thereby the spacing between the base beams and the platform beams.

13. A device according to claim 12 wherein the smaller of each of said pairs of such telescoping tubes is marked with indicia adjacent its entry end into the larger tube to show the adjusted length of the telescoped tubes.

14. A device for tilting a vehicle to permit servicing of the running gear and underside thereof, comprising:

(a) a pair of spaced, parallel base beams;

(b) a pair of spaced, parallel, vehicle receiving platform beams, each of said platform beams being pivoted at one end to and above one of said base beams;

(c) a folding lift unit including a fluid pressure applying device and a lever mechanism housed within and between one of said base beams and its associated platform beam;

(d) said fluid pressure applying device being connected to one of said members of said associated base and platform beams, and to one part of said lever mechanism, and another part of said lever mechanism being connected to the other member of said associated base and platform beam;

(e) means for suppying fluid pressure to said pressure applying device whereby to tilt said platform beams relative to said base beams; and (f) an accessory for freeing the wheels of a vehicle loaded on the platform beams for wheel servicing, said accessory comprising a pair of telescoped tubes for placement transversely of the platform beams, a pair of bracket members each having a vertical plate secured to the outer end of one of said tubes and a horizontal flange for engaging under a vehicle frame portion, and a pair of pressure fluid lift jacks removeably placeable on said platform beams and under said flanges of the bracket members.

15. A device according to claim 14 including stop bars affixed to the outer edges of said bracket flanges and protruding downwardly to prevent slippage of the lift jacks.

* * * * *